US006312276B1

(12) United States Patent
Lin

(10) Patent No.: US 6,312,276 B1
(45) Date of Patent: Nov. 6, 2001

(54) TERMINALS FOR ACHIEVING PREFERRED ELECTRIC AND MECHANIC CONNECTION

(75) Inventor: Chien-Chung Lin, Taoyuan (TW)

(73) Assignee: Fullcom Technology Corp., Taoyuan (TW)

( * ) Notice: Subject to any disclaimer, the term of this patent is extended or adjusted under 35 U.S.C. 154(b) by 0 days.

(21) Appl. No.: 09/760,652

(22) Filed: Jan. 17, 2001

(51) Int. Cl.[7] ..... H01R 4/50
(52) U.S. Cl. ..... 439/342
(58) Field of Search ..... 439/342, 862, 439/259, 268, 856

(56) References Cited

U.S. PATENT DOCUMENTS 5,443,591 * 8/1995 Tsai ..... 439/342
5,685,748 * 11/1997 Harting et al. ..... 439/862
6,074,233 * 6/2000 Lin ..... 439/342

* cited by examiner

*Primary Examiner*—Neil Abrams
*Assistant Examiner*—Phuong KT Dinh
(74) *Attorney, Agent, or Firm*—Rosenberg, Klein & Lee

(57) ABSTRACT

A terminal structure comprises a mounting portion, an inserting portion, and a contact portion. The mounting portion has two sides each having a positioning tooth; and the inserting portion is connected to a lower end the mounting portion. The contact portion is installed above the mounting portion, and a fork shape first arm and a fork shape second arm extends from an upper end of the mounting portion. The second arm has a connecting portion extending from a lower end at one side of the first arm for being formed as a suspending arm with a free upper end and slightly tilt to a front side or outer side of the terminal. The contact portion is connected to an upper end of the second arm. Therefore, a terminal is formed, which can achieve a preferred electric and mechanic connection with the electronic elements of a pin grid array (PGA) chip.

7 Claims, 5 Drawing Sheets

TERMINALS FOR ACHIEVING PREFERRED ELECTRIC AND MECHANIC CONNECTION

FIELD OF THE INVENTION

The present invention relates to a terminal for achieving a preferred electric and mechanic connection comprises a mounting portion suitable to be mount to a connector, which can achieve a preferred electric and mechanic connection with the electronic elements of an pin grid array (PGA) chip.

BACKGROUND OF THE INVENTION

In general, connectors are welded to a circuit board for receiving proper electronic elements so as to achieve a preferred connection between the electronic elements and the circuit board. For a pin grid array (PGA) chip, it is desired to have a zero inserting force (ZIF) as a terminal is inserted into the connector.

For the terminals of the connectors of a ZIF chip connector, the chip connector can be classified as two classes. In one kind, the terminal has a single one contacting arm, and a pin extending from a lower side of the chip serves to clamp the contact arm so as to achieve electric and mechanic connections between the connector and the pin of the chip. These kinds of terminals are disclosed in for example U.S. Pat. Nos. 3,315,212, 4,501,461, 4,674,811, 4,887,974, 4,988,310, 5,013,256, and 5,052,101, etc.

Another kind of terminal has two contact arms, in that a pin extends from the lower end of the chip serves to be clamped between two contact arms so as to achieve electric and mechanic connections between the connector and the pin of the chip. These kinds of terminals are disclosed in for example U.S. Pat. Nos. 3,676,872, 3,763,459, 4,331,371, 4,381,130, 4,397,512, 4,468,072, 4,498,725, 4,648,669, etc. Terminals with two contact arms have a preferred elasticity so that as the pin of a chip is inserted into the connector, a preferred electric and mechanic connection is achieved.

Referring to FIG. 1, a prior art terminal is shown, in that the terminal 10*a* has a Y shape and a bending portion 11*a* is installed at the middle portion thereof. A lower end of the bending portion 11*a* is formed with a thin long inserting portion 12*a*. The upper end of the inserting portion 12*a* is extended with two forked arms. The upper end of one arm is a contact portion 13*a*. The inner side of the contact portion 13*a* is extended with a tilt guiding portion 14*a*. Two sides of the upper end of the terminal 10*a* are formed with positioning teeth 15*a* for being buckled to the inner wall of the connector.

However, in the prior art terminal structure, the arms of the contact portion 13*a* are extended from the middle portion of the terminal 10*a*. The lower end of the arm has a wider portion serving to be connected to the upper end of the terminal 10*a*. Therefore, the elasticity of the contact portion 13*a* is low and the tightness of the terminal and the pin of a chip is not good so that it is hard to achieve a required electric and mechanic connection.

SUMMARY OF THE INVENTION

Accordingly, the primary object of the present invention is to provide a terminal structure, wherein the second arm of the contact portion extends from a first arm instead of extending from an upper end of the mounting portion. Furthermore, the connecting portion of the first arm is approximately equal to that of the second arm so that the second arm is formed with an elastic suspending arm which has a preferred elasticity and a strong force. The tightness between the terminal and the pin of the chip is good so as to achieve a preferred electric and mechanic connection.

To achieve the aforesaid object, the present invention provide a terminal structure comprising a mounting portion, an inserting portion, and a contact portion. The mounting portion has sides each having a positioning tooth; and the inserting portion is connected to a lower end the mounting portion. The contact portion is installed above the mounting portion, and a fork shape first arm and a fork shape second arm extends from an upper end of the mounting portion. The second arm has a connecting portion extending from a lower end at one side of the first arm for being formed as a suspending arm with a free upper end and slightly tilt to a front side or outer side of the terminal. The contact portion is connected to an upper end of the second arm. Therefore, a terminal is formed, which can achieve a preferred electric and mechanic connection with the electronic elements of an pin grid array (PGA) chip.

The various objects and advantages of the present invention will be more readily understood from the following detailed description when read conjunction with the appended drawing.

DETAILED DESCRIPTION OF THE PREFERRED EMBODIMENTS

Figure 1:
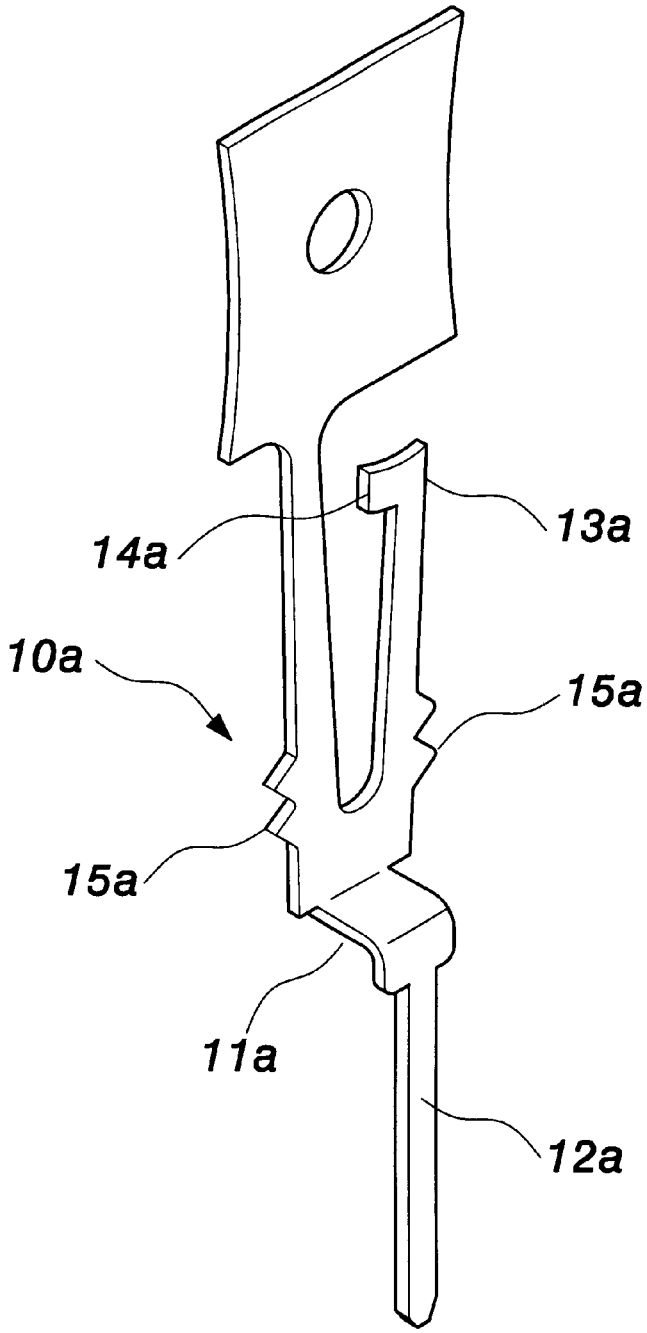
FIG. 1 PRIOR ART
FIG. 1 is a perspective view showing a prior art terminal being connected to a material strip.
Figure 2:
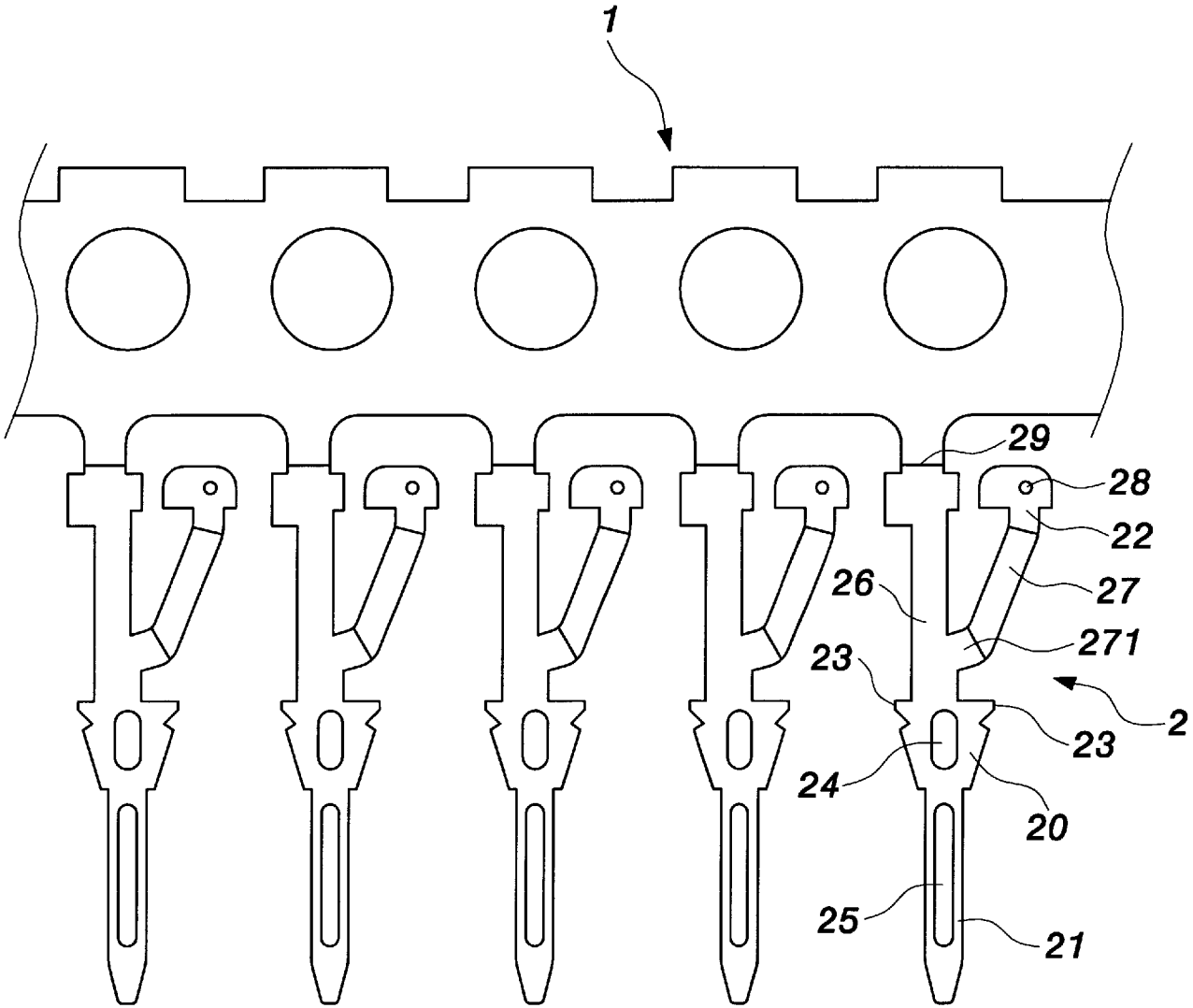
FIG. 2 is a front view showing that the terminal of the present invention is connected to a material strip.
Figure 5:
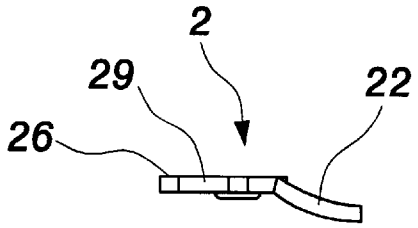
FIG. 5 is an elevation view of the terminal in the resent invention.
Figure 3:
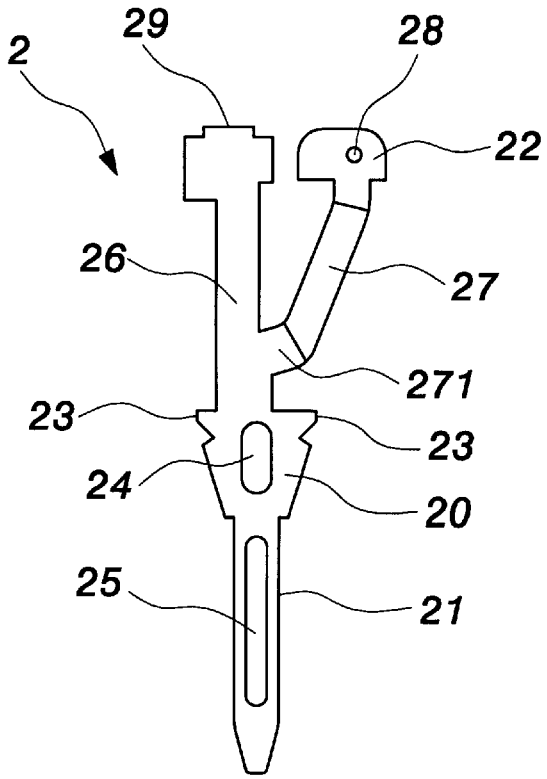
FIG. 3 is a front view of the terminal in the present invention.
Figure 4:
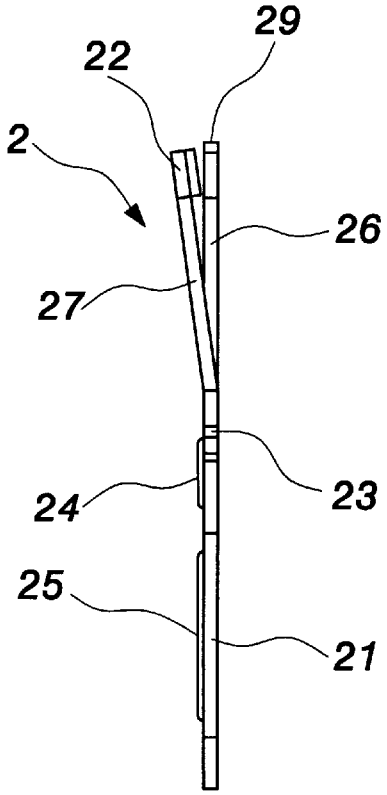
FIG. 4 is a lateral view of the terminal in the present invention.
Figure 6:
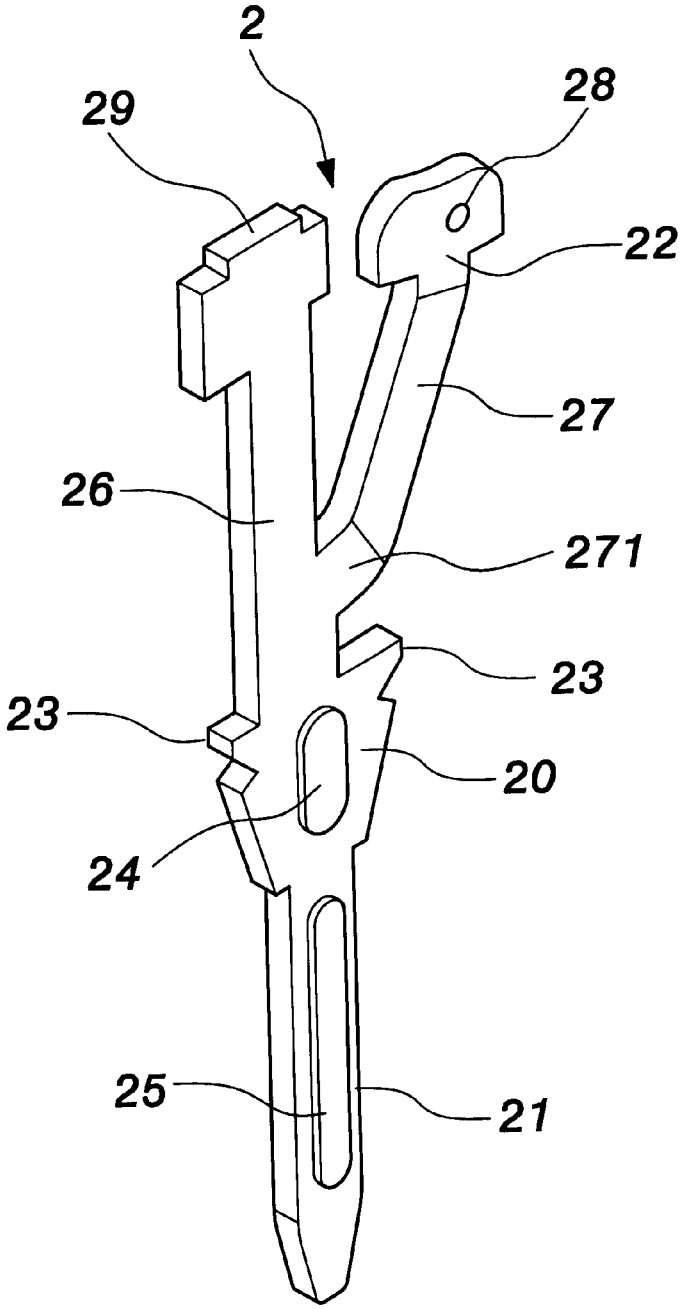
FIG. 6 is a perspective view of the terminal in the present invention.

Referring to FIGS. 2 to 6, a terminal structure is illustrated. In the present invention, the terminals 2 are made as a strip (referring to FIG. 2). The terminals 2 are shaped by punching and then are cut for being separated with the stripe 1.

The terminal 2 is made of conductive material and includes a mounting portion 20, an inserting portion 21, and a contact portion 22. The mounting portion 20 has a flat shape and two sides thereof are installed with respective positioning teeth 23 for being engaged to the inner wall of the flat plate. A short protrusion 24 is punched on the mounting portion 20 for enhancing the strength of the mounting portion 20 so as to prevent the swing of the terminals 2. Therefore, the present invention has a preferred positioning effect and a good resisting force.

The inserting portion 21 is integral formed and is connected to the lower end of the mounting portion 20. The inserting portion 21 is a long thin shape. A long protrusion 25 is punched on the inserting portion 21. The long protrusion 25 extends along the longitudinal direction of the inserting portion 21 with a proper length for enhancing the strength of the inserting portion 21.

The contact portion 22 is integrally formed and is connected to the upper side of the mounting portion 20. A fork shape first arm 26 and a second arm 27 extends from the upper end of the mounting portion 20. The first arm 26 faces upwards and straightly extends so as to be connected to the material strip 1. A cutting line 29 is installed between the first arm 26 and the material strip 1, and thereby, the terminal 2 can be separated with the material strip 1. The second arm 27 extends upwards from a connecting portion 271 near the right lower end of the first arm 26 so as to be formed as a suspending arm with an upper free end. The second arm 27 is slightly bent toward the front side and outer side of the terminal 2. The contact portion 22 is connected to the upper end of the second arm 27. The contact portion 22 is a cambered piece body and has an effect of guiding. A pit 28 is punched on the contact portion 22. By the aforesaid components, a terminal structure of the present invention is formed.

Figure 7:
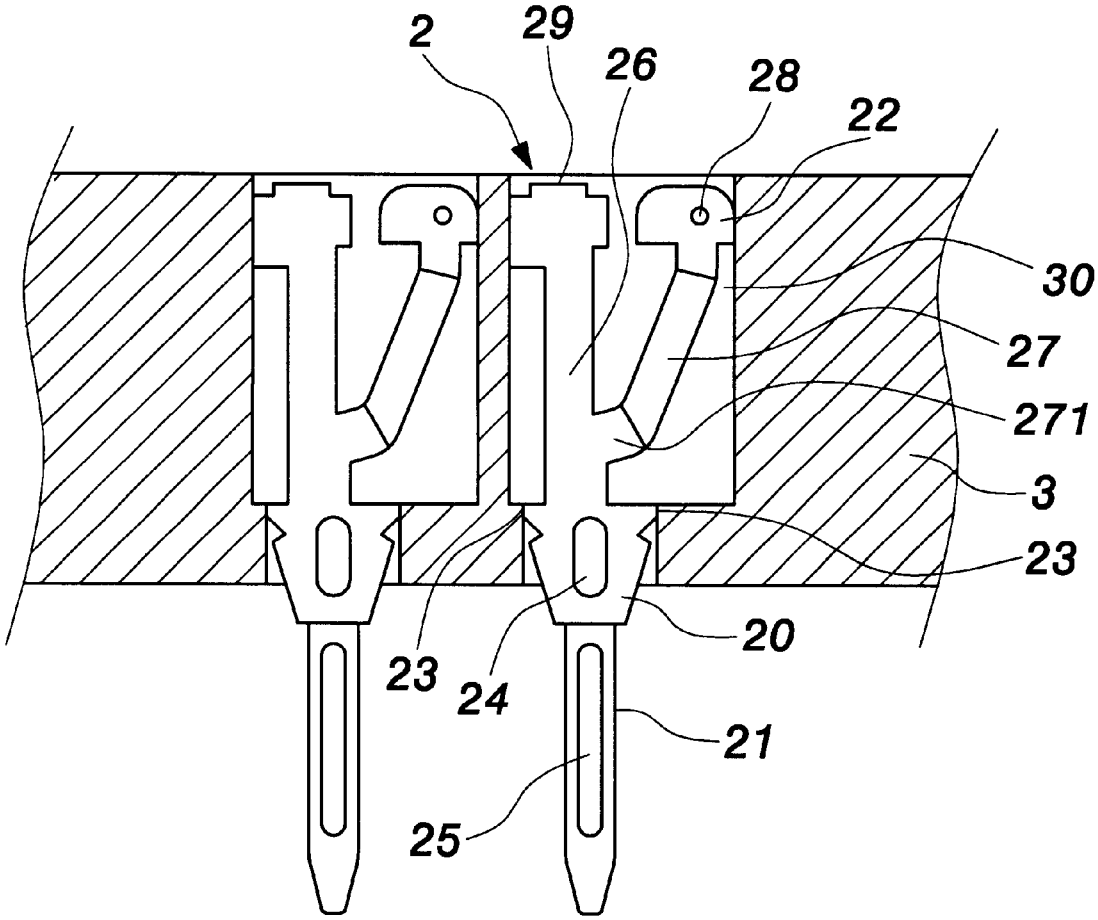
FIG. 7 is a schematic view showing that the terminal of the present invention is mounted to a connector.

Referring to FIG. 7, the terminal 2 of the present invention can be mounted a terminal receiving hole 30 of an insulating seat 3. The positioning teeth 23 at two sides of the mounting portion 20 can be engaged to the inner wall of the terminal receiving hole 30 of a connector. A short protrusion 24 is punched on the mounting portion 20 for enhancing the strength of the mounting portion 20 and for prevent the terminal 2 from swinging so as to provide a preferred positioning effect and has a strong resisting force. The inserting portion 21 of the terminal 2 exposes from the bottom of the insulating seat 3 for being inserted to a circuit board. The contact portion 22 of the terminal 2 may be in contact with pines (not shown) extending from a lower side of a chip of a connector. The contact portion 22 has a preferred guiding effect so that the pin can contact the contact portion 22 substantially. Therefore, the electrical and mechanical connections between a connector and a pin of a chip are accomplished.

In the present invention, the second arm 27 of the contact portion 22 extends from a lateral side of the first arm 26 instead of extending from the upper end of the mounting portion 20 and further, the connecting portion 271 at the lower end of the second arm 27 has a width approximately equal to that of the second arm 27 so that the second arm 27 is formed as an elastic suspending arm and has a preferred elasticity. As the terminal 2 is in contact with the pin of chip, a better tightness is provided. Therefore, preferred electric and mechanic connections are provided.

In summary, the present invention has improved the defects in the prior art. In the prior art, the elasticity of the contact portion is low, and the tightness between the contact portion and the pin of a chip is bad such that it is hard to achieve a better electric and mechanic connection.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A terminal for a connector comprising:

(a) a mounting portion having a forward directed front side extending between a pair of laterally directed sides, each of said laterally directed sides forming at least one positioning tooth;

(b) an inserting portion extending longitudinally downward from said mounting portion;

(c) a first arm portion extending longitudinally upward from said mounting portion to terminate at a first upper end;

(d) a second arm portion suspended from said first arm portion, said second arm portion being biased to extend upward in forward and lateral inclined manner, said second arm portion terminating at a second upper end disposed in spaced relation to said first upper end; and, (e) a contact portion coupled to said second upper end of said second arm portion.

2. The terminal as recited in claim 1 wherein said mounting portion includes a protrusion formed thereon.

3. The terminal as recited in claim 1 wherein said inserting protrusion includes an elongate protrusion formed to extend longitudinally thereon.

4. The terminal as recited in claim 1 further comprising a material strip separably joined to said first upper end of said first arm portion along a cutting line defined therebetween.

5. The terminal as recited in claim 1 wherein said first arm portion joins said second arm portion at a lower part thereof, said lower part being substantially equal in width to said second arm portion.

6. The terminal as recited in claim 1 wherein said contact portion forms a cambered configuration.

7. The terminal as recited in claim 1 wherein said contact portion includes a pit formed therein.

* * * * *